United States Patent [19]

Yamada et al.

[11] Patent Number: 4,571,367

[45] Date of Patent: Feb. 18, 1986

[54] HOT-DIP ALUMINUM COATED STEEL STRIP HAVING EXCELLENT STRENGTH AND OXIDATION RESISTANCE AT ELEVATED TEMPERATURES AND PROCESS FOR PRODUCTION THEREOF

[75] Inventors: Toshiro Yamada; Noriyasu Sakai; Hisao Kawase, all of Hiroshima, Japan

[73] Assignee: Nisshin Steel Co., Ltd., Tokyo, Japan

[21] Appl. No.: 709,947

[22] PCT Filed: Jul. 3, 1984

[86] PCT No.: PCT/JP84/00343

§ 371 Date: Feb. 26, 1985

§ 102(e) Date: Feb. 26, 1985

[87] PCT Pub. No.: WO85/00383

PCT Pub. Date: Jan. 31, 1985

[30] Foreign Application Priority Data

Jul. 4, 1983 [JP] Japan ..... 58-121277

[51] Int. Cl.[4] ..... B32B 15/18

[52] U.S. Cl. ..... 428/653; 148/12 R

[58] Field of Search ..... 148/12 R; 428/653

[56] References Cited

U.S. PATENT DOCUMENTS

| | | | |
|---|---|---|---|
| 3,881,881 | 5/1975 | Kim | 428/653 |
| 4,144,378 | 3/1979 | Kim | 428/653 |
| 4,517,229 | 5/1985 | Nickola et al. | 428/653 |

*Primary Examiner*—Wayland Stallard

*Attorney, Agent, or Firm*—Wenderoth, Lind & Ponack

[57] ABSTRACT

Commercial process for the production of hot-dip aluminum coated steel strip or sheet having improved strength and oxidation resistance at elevated temperatures wherein a Ti containing extremely low carbon Si-Mn steel is used as a steel substrate for hot-dip coating and wherein in the hot rolling step in the manufacture of the steel substrate the temperature of the hot rolled material being coiled is controlled low enough to provide steel surfaces substantially free from internal oxidation at the end of the descaling step.

6 Claims, 18 Drawing Figures

FIG. 1a
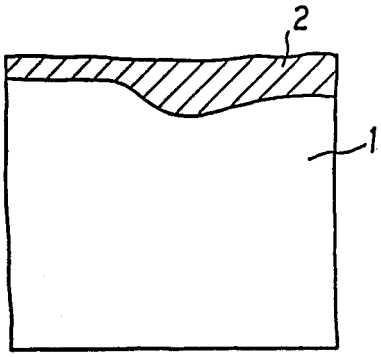
FIG. 1b
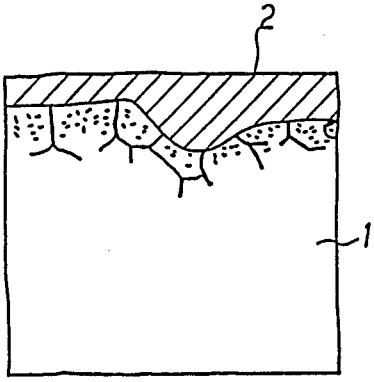
FIG. 1c
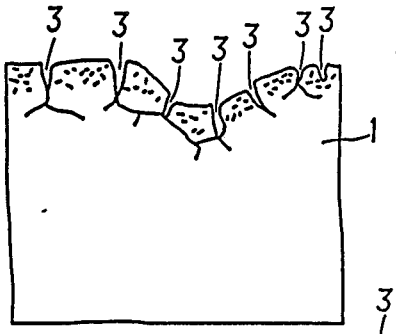
FIG. 1d
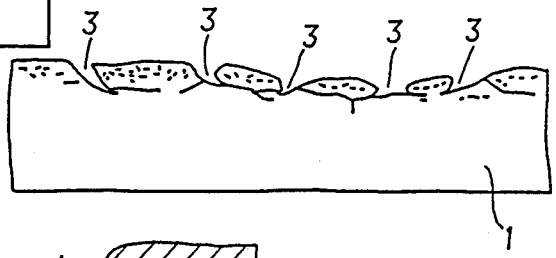
FIG. 1e
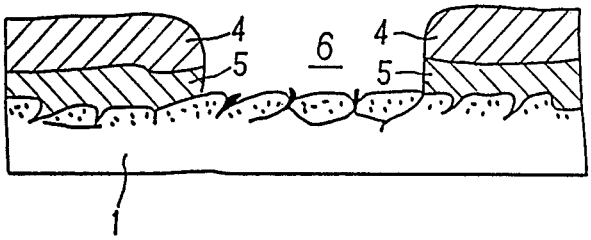
(f)
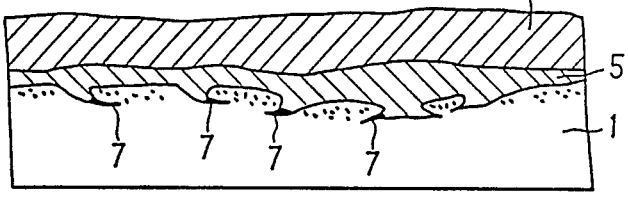
FIG. 1f THICKNESS OF LAYER OF INTERNAL OXIDES(μm)

○ 0

◐ 0 ~ 5

⊕ 5 ~ 10

◑ 10 ~ 15

⊖ 15 ~ 20

● 20 ~ 25

} INTER-GRANULAR OXIDATION

---- INTER-AND INTER-GRANULAR OXIDATION

HOT-DIP ALUMINUM COATED STEEL STRIP HAVING EXCELLENT STRENGTH AND OXIDATION RESISTANCE AT ELEVATED TEMPERATURES AND PROCESS FOR PRODUCTION THEREOF

TECHNICAL FIELD OF THE INVENTION

The present invention relates to a hot-dip aluminum coated steel strip having excellent strength and oxidation resistance at elevated temperatures and a process for the production thereof. Particularly, it relates to a hot-dip aluminum coated low alloy steel strip which may be substituted for AISI 409 and 410 as a material for automobile exhaust gas systems, and to a process for the production of the same.

BACKGROUND OF THE INVENTION

Hot-dip aluminum coated steel sheet products are roughly classified into two types. One is for use in applications where heat resistance is required, while the other is for use in applications where corrosion resistance is required. Generally, the former is called a Type I aluminum coated steel sheet, while the latter is called a Type II aluminum coated steel sheet. The Type I aluminum coated steel sheet contains in its Al coatings a small amount of Si, which serves, when the product is heated at elevated temperatures, to suppress development of a Fe-Al alloy layer, rendering the product heat resistant. Even with such Type I aluminum coated steel sheets, the service temperature of the products which have been commercially available is normally about 600° C. or below. On the other hand the Type II aluminum coated steel sheet has practically pure Al coatings. When compared with Type I products, Type II products are more corrosion resistant but less heat resistant.

Such a hot-dip aluminum coated steel sheet or strip is usually produced by hot-dipping a cold rolled strip of an aluminum killed steel or rimmed steel as a steel substrate in a hot-dip aluminum coating bath. In a commercial scale production, a steel slab is subjected to the steps of hot rolling, descaling, cold rolling, annealing and hot-dip aluminum coating, and the last-mentioned steps of annealing and hot-dip aluminum coating are normally carried out by passing the cold rolled strip of the steel substrate through a so-called Senzimir type hot-dip aluminum coating line installed with an in-line annealing equipment.

Japanese Patent Publication No. 53-15454 corresponding to U.S. Pat. No. 3,881,880 proposes preparation of a strip of an aluminum killed carbon steel which contains about 0.03% to about 0.25% by weight of carbon and has an amount of titanium added sufficient to precipitate the carbon in the steel and to provide an excess of uncombined titanium ranging between about 0.1% and 0.3% by weight, and hot-dip coating of the so prepared base steel strip with aluminum. It is taught in this patent that all the carbon in the steel is precipitated as titanium carbide to leave substantially no carbon in solution in the steel, in other words a steel base which resembles pure iron is provided, and in consequence, when the aluminum coated product is heated at elevated temperatures, Al in the coating layers is liable to diffuse into the steel base, whereby the oxidation resistance of the surfaces of the steel base may be improved.

On the other hand automobile manufacturers have recently requested and are now requesting, as a material for automobile exhaust gas systems, hot-dip aluminum coated steel strips, which have, in addition to an improved oxidation resistance at elevated temperatures, an improved strength at elevated temperatures (for example a tensile strength of at least 13 kgf/mm$^2$, preferably at least 15 kgf/mm$^2$, at 600° C.), and which may be substituted for expensive AISI 409 and 410 stainless steels. The above-mentioned patent does not teach how to commercially advantageously produce a hot-dip aluminum coated steel strip which has the requested strength at elevated temperatures as well as the improved oxidation resistance taught in that patent.

DISCLOSURE OF THE INVENTION

An object of the invention is to establish a commercially advantageous process for the production of a hot-dip aluminum coated steel strip having excellent strength and oxidation resistance at elevated temperatures.

Another object of the invention is to provide a hot-dip aluminum coated steel strip having excellent strength and oxidation resistance at elevated temperatures.

According to the invention it has now been found that the addition of suitable amounts of Si and Mn as alloying elements to a base steel having carbon extremely reduced does not detract from the beneficial operation and effect of titanium added to the base steel as taught by the above-mentioned Japanese Patent Publication No. 53-15454 and U.S. Pat. No. 3,881,880 corresponding thereto, and thus the intended strength at elevated temperatures can be achieved. This finding is surprising in view of the fact that the above-mentioned patent teaches that it is important to avoid intentional addition of alloying elements other than titanium thereby to obtain a steel base resembling substantially pure iron for the promotion of Al diffusion from the coating layer into the surface zones of the base steel. It is generally known in the art that on the one hand both Si and Mn are alloying elements which serve to increase the strength of steel, and on the other hand a Ti added steel has an increased secondary recrystallization temperature. It is therefore conceivable that a Ti added Si-Mn steel would exhibit an improved strength at elevated temperatures below its secondary recrystallization temperature. However, an attempt to commercially produce a hot-dip aluminum coated steel strip by forming a cold rolled strip of a Ti added Si-Mn steel in a conventional commercial production line using conventional conditions for the production of such a material and passing it through a Senzimir type hot-dip aluminum coating line installed with an in-line annealing equipment, has resulted in failure. The coated product so obtained had discrete non-coated areas and was not resistive to oxidation at elevated temperatures.

It has now been found that a hot-dip aluminum coated steel strip or sheet having enhanced oxidation resistance and strength at elevated temperatures may be commercially successfully produced, if a Ti added Si-Mn steel in which the alloying elements are properly adjusted, is used as a steel substrate, and if the coiling temperature in the manufacturing process is controlled low enough to prevent the Si and Mn in the steel from being oxidized.

Thus, the invention provides a process for the production of a hot-dip aluminum coated steel strip comprising sequentially subjecting a slab of steel having an amount of titanium added sufficient to precipitate the carbon and nitrogen in said steel and to provide an excess of uncombined titanium to the steps of hot rolling, descaling, cold rolling, annealing and hot-dip aluminum coating, characterized in that as said slab use is made of a Ti-added Si-Mn steel which comprises in % by weight up to 0.020% of C, 0.1 to 2.2% of Si, up to 2.5% of Mn, 0.1 to 0.5% of Ti, 0.01 to 0.1% of Al and up to 0.010% of N, the balance being Fe and unavoidable impurities, the % Si, % Mn, % Ti, % C and % N being further controlled in compliance with the relations:

$$1.9\times(\%\ Si)+0.9(\%\ Mn)\geqq 1,$$

$$\%\ Mn\geqq 0.5\times(\%\ Si),\ \text{and}$$

$$\%\ Ti/(\%\ C+\%\ N)\geqq 10,\ \text{and}$$

that in said hot rolling step the temperature of the hot rolled material being coiled is controlled low enough to provide steel surfaces substantially free from internal oxidation at the end of said descaling step.

In accordance with the invention a hot-dip aluminum coated steel strip or sheet having excellent strengh and oxidation resistance at elevated temperatures, comprises a steel substrate of a Ti-added Si-Mn steel which consists essentially of in % by weight up to 0.020% of C, 0.1 to 2.2% of Si, up to 2.5% of Mn, 0.1 to 0.5% of Ti, 0.01 to 0.1% of Al and up to 0.010% of N, the balance being Fe and unavoidable impurities, the % Si, % Mn, % Ti, % C and % N being further controlled in compliance with the relations:

$$1.9\times(\%\ Si)+0.9\times(\%\ Mn)\geqq 1,$$

$$\%\ Mn\geqq 0.5\times(\%\ Si)$$

and $$\%\ Ti/(\%\ C+\%\ N)\geqq 10,$$

said steel being a substantially free from internal oxidation, and hot-dip aluminum coating layers on the surfaces of the steel substrate. In the case of Type I products, there is an intermediate layer consisting essentially of Al-Fe-Si alloys at the interface between each Al coating (more precisely Al-Si coating) and the steel substrate.

With a Ti-containing extremely low carbon Si-Mn steel having Si and Mn added as alloying elements in amounts prescribed herein, it has been found that if the finish hot rolled material has been coiled to a hot coil at a coiling temperature conventionally used with this type of steels, scales inevitably existing on the surface of the steel oxidize Si and Mn in solution in the steel during the cooling of the hot coil (normally it is allowed to cool), and thus the oxides of Si and Mn so formed precipitate inter-granules or inter- and intra-granules in the surface zones of the steel. Such oxidation of Si and Mn in the steel will be referred to herein as "internal oxidation". While the internal oxidation is limited to the surface zones of the steel, it reaches a depth of several microns to a few tens of microns depending upon conditions including the composition of the steel, the coiling temperature and the rate of cooling after coiling. Although oxides of Si and Mn formed by the internal oxidation precipitate inter-granules or inter- and intra-granules in the surface zones of the steel as stated above, and do not form a continuous layer, by the term "a layer of internal oxides" is meant herein a whole of the internal oxides formed. It should be noted that the internal oxides are completely different from scales on the surfaces of the steel in their components and nature.

BRIEF EXPLANATION OF THE DRAWINGS

FIGS. 1(*a*),(*b*),(*c*),(*d*),(*e*) and (*f*) are enlarged diagrammatic cross-sectional views of a steel surface in various steps of the manufacturing process for illustrating the behavior of internal oxides;

DETAILED DESCRIPTION OF THE INVENTION

Figure 2A:
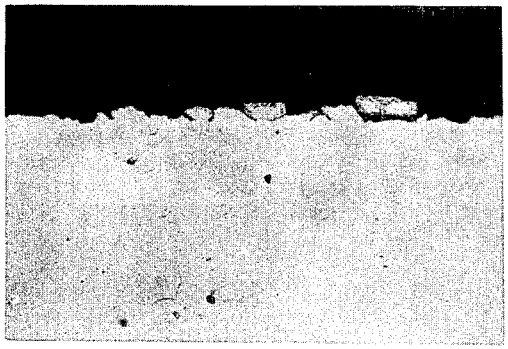
FIGS. 2(*a*) and (*b*) are microscopic photos (all with a magnification of 400) of a cross-section of a steel substrate having internal oxides, before and after hot-dip aluminum coating, respectively.

FIG. 1(*a*) is an enlarged diagrammatic cross-sectional view of a surface of a Ti-containing extremely low carbon Si-Mn steel having Si and Mn added in amounts prescribed herein, after having been hot rolled and immediately before being coiled. On the surface of the steel base 1, scales 2 have been formed. Such scales are called secondary scales. On the surfaces of a slab which has been heated at elevated temperatures in a heating furnace, scales called primary scales are present, and most of them are removed from the surfaces during the hot rolling step. Most of the secondary scales 2 are formed while the hot rolled strip is carried from a finish hot roll mill to a coiler.

FIG. 1(*b*) is a similar cross-sectional view of the steel surface, after the hot rolled material having secondary scales 2 as shown in FIG. 1(*a*) has been coiled at a temperature substantially in excess of 600° C. (for example, at a temperature of about 700° C.) and then allowed to cool. During the cooling of the hot coil, internal oxidation has occurred inter- and intra-granules in the surface zones of the steel. The precipitated oxides are those of Si and Mn which have been formed by the reaction of the Si and Mn dissolved in the steel with oxygen supplied by the scales 2 comprising iron oxides.

FIG. 1(*c*) is a similar cross-sectional view of the steel surface, after the hot rolled material shown in FIG. 1(*b*) has been descaled by pickling. The scales 2 are removed by pickling. But oxides which have precipitated intra-granules remains unremoved, and oxides which have precipitated inter-granules are only partly removed to form intergranular clearances 3.

FIG. 1(*d*) is a similar cross-sectional view of the steel surface, after the descaled material shown in FIG. 1(*c*) has been cold rolled. The surface of the cold rolled material is not smooth, and the clearances 3 are enlarged and deformed by cold rolling. The layer of internal oxides remains after cold rolling. Rolling oil used in the cold rolling step and other alien substances are apt to enter the enlarged and deformed clearances 3 on the steel surface, and they are not always completely removed by the subsequent annealing treatment in the coating line.

FIGS. 1(*e*) and (*f*) are similar cross-sectional views of the steel surface, after the cold rolled material shown in FIG. 1(*d*) has been hot-dip aluminum coated by passing it through an in-line annealing type hot-dip aluminum coating line. If the alien substances, which has entered inter-granular clearances on the surface of the cold rolled material, are not completely removed, no aluminum coating frequently adheres to that areas of the steel base where alien substances remain unremoved, as shown in FIG. 1(*e*). In FIGS. 1(*e*) and (*f*), the numeral 4 designates an aluminum coating layer (Al-Si layer), the numeral 5 designates an Al-Fe-Si alloy layer formed at the interface between the aluminum coating layer 4 and the steel base 1, and the numeral 6 in FIG. 1(*e*), designates a non-coated area.

Figure 2B:
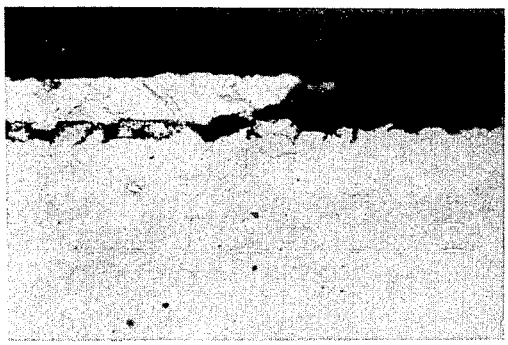
Figure 3A:
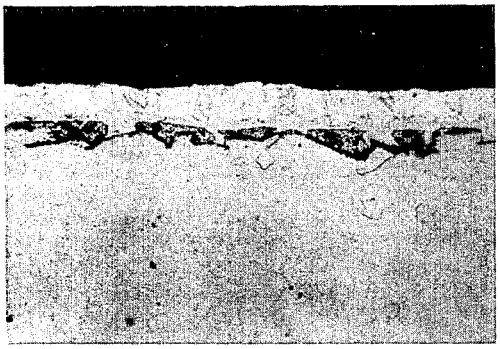
FIGS. 3(*a*),(*b*),(*c*) and (*d*) are microscopic photos (all with a magnification of 400) for illustrating how the presence or absence of internal oxides affects the oxidation resistance of the coated product at elevated temperatures.
Figure 3B:
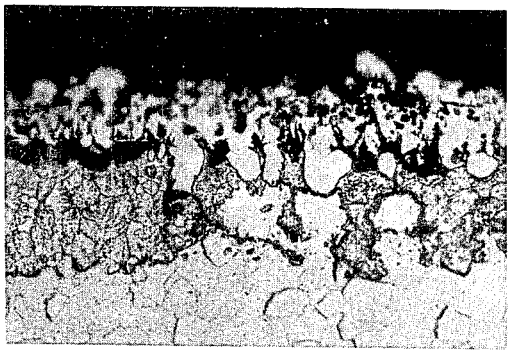
Figure 3C:
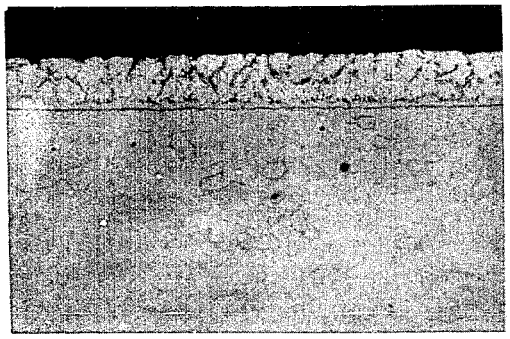
Figure 3D:
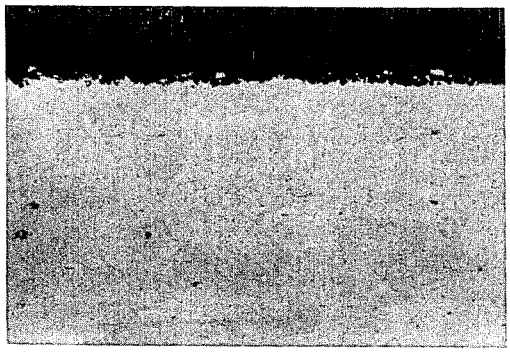
Figure 4A:
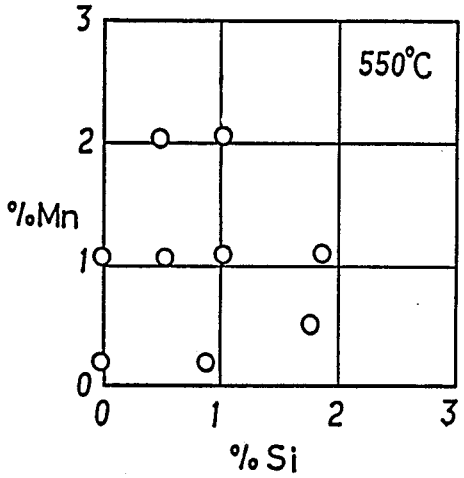
FIGS. 4(*a*),(*b*),(*c*) and (*d*) are graphic representations showing experimental results on a dependancy of the formation of internal oxides on the temperature and the Si and Mn content of the Si-Mn steel.
Figure 4B:
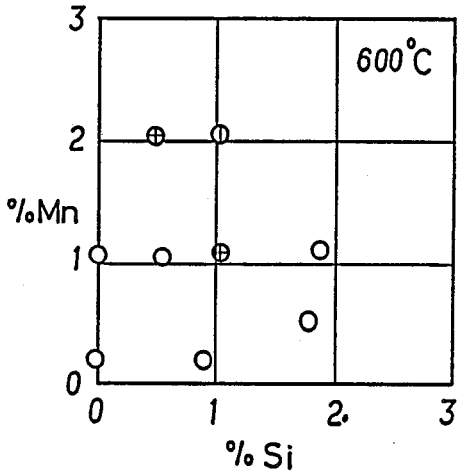
Figure 4C:
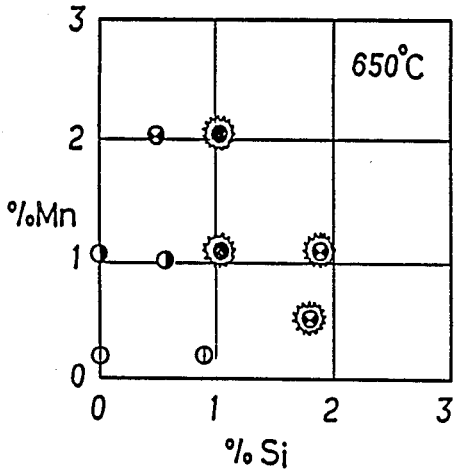
Figure 4D:
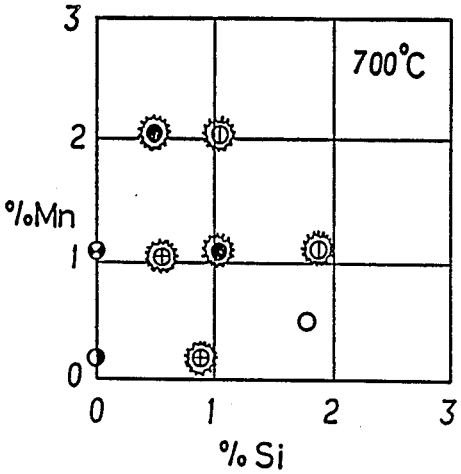

FIGS. 2(*a*) and (*b*) are microscopic photos with a magnification of 400 of cross-sections of the sample, before and after hot-dip aluminum coating, respectively, for illustrating an instance wherein "non-coating" has occurred.

Even in cases wherein "non-coating" does not occur, the thickness of the Al-Fe-Si alloy layer 5 formed at the interface between the Al-Si coating layer 4 and the steel substrate 1, tends to be larger than usual, as seen from FIG. 1(*f*). This is believed because the surface area of the cold rolled material is larger than apparent due to the presence of inter-granular clearances 3. The larger the thickness of the Al-Fe-Si alloy layer 5, the more readily the coating layers tend to peel off upon mechanical working of the coated product. In addition, deep portions (ends) of the clearances 3 are apt to become voids 7 even after the hot-dip coating, and the presence of such voids also causes the coating to peel off.

FIG. 3(*a*) is a microscopic photo (with a magnification of 400) of the coated product as shown in FIG. 1(*f*). The internal oxides are not reduced by a reducing annealing atmosphere used in the hot-dip coating line, and still remain unremoved even after the hot-dip coating, as seen from the photo of FIG. 3(*a*) and shown in the diagrammatic view of FIG. 1(*f*).

The layer of internal oxides (inter-granular film-like oxides and intra-granular particulate oxides) acts, when the coated product is heated at elevated temperatures, as a barrier to prevent Al from diffusing from the Al coating into the steel substrate, and in consequence detracts from the oxidation resistance of the product at elevated temperatures, which is aimed to be enhanced by the intentional addition of Ti.

FIG. 3(*b*) is a microscopic photo of the same magnification showing a cross-section of the same product shown in FIG. 3(*a*) after it has been heated in air at 800° C. for 20 hours. It will be seen from this photo that the presence of the layer of internal oxides remarkably impairs the oxidation resistance of the coated product at elevated temperatures. Furthermore, when the product is heated at elevated temperatures, the internal oxidation in itself proceeds more deeply into the steel substrate.

To summarize, the presence of the internal oxide layer comprising oxides of Si and Mn in the surface zones of the steel substrate of the hot-dip aluminum coated steel product, (1) remarkably impairs the surface smoothness of the cold rolled material, and in consequence invites
  (a) occurance of "non-coating"due to adhesion of alien substances,
  (b) an increase of the thickness of the Al-Fe-Si alloy intermediate layer owing to an increase of the surface areas, and
  (c) weakening of the adhesion strength of the coating, and
(2) when the product is heated at elevated temperatures, prevents the formation of the Al diffusion layer, and as a result, deteriorates the oxidation resistance of the product at elevated temperatures and causes the coating layer to peel off.

Accordingly, it is essential for the purpose of the invention that in the production of the steel substrate to be coated, steel surfaces substantially free from internal oxidation be provided at the end of the descaling step. This can be achieved according to the invention by controlling the coiling temperature, that is the temperature of the hot rolled material being coiled, sufficiently low.

In order to determine the upper limit of the acceptable coiling temperature the following tests were carried out in laboratory.

Table 1 indicates the chemical composition of tested steel specimens (1.0 mm in thickness), which were prepared from respective molten steel by forging, hot rolling (to 7.0 mm), grinding (to 5.0 mm) and cold rolling (to 1.0 mm).

TABLE 1

| | Chemical Composition of Specimens (% by weight) | | | | | | |
|---|---|---|---|---|---|---|---|
| No. | C | Si | Mn | P | S | Ti | Sol. Al |
| 1 | 0.002 | 0.005 | 0.19 | <.005 | 0.004 | 0.22 | 0.040 |
| 2 | 0.004 | 0.010 | 1.08 | <.005 | <.003 | 0.23 | 0.060 |
| 3 | 0.004 | 0.90 | 0.20 | 0.005 | 0.004 | 0.16 | 0.022 |
| 4 | 0.004 | 0.57 | 1.04 | 0.002 | 0.012 | 0.25 | 0.041 |
| 5 | 0.003 | 0.49 | 2.06 | 0.002 | 0.005 | 0.17 | 0.029 |
| 6 | 0.012 | 1.05 | 1.09 | 0.003 | 0.006 | 0.19 | 0.065 |
| 7 | 0.003 | 1.05 | 2.06 | 0.003 | 0.004 | 0.19 | 0.053 |
| 8 | 0.005 | 1.81 | 0.51 | 0.002 | 0.004 | 0.17 | 0.022 |
| 9 | 0.004 | 1.89 | 1.11 | 0.003 | 0.004 | 0.22 | 0.067 |

Each specimens was heated in air at an elevated temperature 20 hours, and the depth of the layer of internal oxides so formed was measured by a microscopic observation. The tests were carried out at temperatures of 550°, 600°, 650° and 700° C. Results are shown in FIG. 4. FIG. 4(*a*) shows results of the test carried out at 550° C. and reveals that no internal oxidation has occurred, irrespective of the Si and Mn content of the tested specimens. FIG. 4(*b*) relates to the test carried out at 600° C. In this case specimens Nos. 5, 6 and 7 have undergone slight internal oxidation, while others have been free from internal oxidation. Occurance of internal oxidation does not directly depend upon the Si and Mn content. It is believed this is because of the different nature of scales formed on the surfaces of the specimens. FIG. 4(*c*) relates to a heating temperature of 650° C. In this case internal oxidation proceeds deeply into the steel except for specimens Nos. 1 and 3 of low Si and Mn. At 700° C., as shown in FIG. 4(*d*), internal oxidation further deeply proceeds except for specimen No. 8. From the test results it appears that in order to provide steel surfaces substantially free from internal oxidation at the end of the conventional descaling step, the coiling temperature used in the hot rolling step should be controlled not higher than about 600° C., preferably not higher than about 570° C., and the most preferably not higher than about 550° C. The lower limit of the coiling temperature is not critical, and depends upon the capacity of the coiler. Normally, it is impractical to coil the hot rolled material at a temperature below about 400° C.

Figure 5:
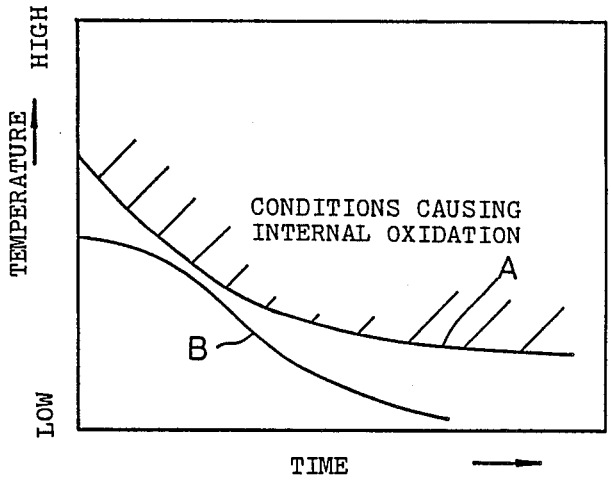
FIG. 5 is a conceptional graphic representation showing a relation between the formation of internal oxides and a cooling curve of the hot coil.

In a commercial production line a hot coil produced in the hot rolling step is normally allowed to stand as coiled to cool except for special cases. The cooling time normally takes 2 to 3 days. While the formation of internal oxides depends upon the content of Si and Mn in the steel, and upon the coiling temperature, that is the temperature from which the hot coil is allowed to cool, it is also affected by a rate of cooling of the hot coil. FIG. 5 is a conceptional graphic representation showing a relation between the formation of internal oxides and a cooling curve of the hot coil. With a given Si-Mn steel, occurance of internal oxidation may be depicted by Curve A. Under conditions represented by points within the hatched area above Curve A, internal oxidation occurs. Curve B represents a cooling curve of the hot coil. According to the invention the coiling temperature must be controlled sufficiently low so that Curve B may not intersect Curve A.

As is known in the art the coiling temperature is an important parameter which affects properties of the product. In a case of a Ti containing low carbon steel, in which Ti is added to fix the carbon and nitrogen in the steel as stable precipitates thereby to enhance the ductility and workability of the steel, a relatively high coiling temperature in excess of 600° C., and in particular not lower than 700° C., has heretofore been used so as to control size of titanium carbide and nitride within a proper range. Ti is again utilized in the practice of the invention to precipitate the carbon and nitrogen in the steel. But the invention intends to improve the strength of the steel by intentionally adding suitable amounts of Si and Mn, instead of by precipitation of titanium carbide and nitride (C is restricted according to the invention to an extremely low level as low as 0.02% or below). A relatively high coiling temperature, which has heretofore been recommended for the production of Ti added steels, has been applied to the production of the Ti-containing extremely low carbon Si-Mn steel intended herein, and using the steel substrate so prepared a hot-dip aluminum coated steel strip has been manufactured in a commercial scale. But the coated product so obtained has proved to be unsatisfactory as described hereinafter in Example 1A. We have found that the cause of the failure is the formation of internal oxides as discussed above, and also found that as a measure to avoid the formation of internal oxides it is essential to coil the hot rolled material at lower temperatures than those recommended in the prior art.

The step of hot rolling referred to herein comprises rough rolling of a slab, finish rolling and coiling the finish rolled material, and includes an intermediate step of removing primary scales such as descaling by water jet. The step of descaling subsequent to the hot rolling step involves a usual chemical or mechanical treatment for removing secondary scales inevitably formed during the hot rolling step. Typically, pickling is carried out in the descaling step. As already stated, internal oxides are not removed in this descaling step. In the cold rolling step, the descaled hot rolled material is cold rolled to a desired thickness with or without pre-annealing.

For the purpose of the invention the chemical composition of the steel substrate is very important. Effects of the alloying elements in the steel substrate as well as criticality of the prescribed range of each element will now be described.

C is an element which adversely affects the oxidation resistance of the aluminum coated steel product at elevated temperatures. First of all C acts to remarkably lower the diffusibility of Al in the steel. Thus, when the aluminum coated steel sheet is heated at high temperatures, C tends to impair the diffusion of Al into the steel substrate, and causes many cavities or voids to be formed at the interface between the steel substrate and aluminum coating. It is believed that these cavities or voids are more readily formed when the diffusion velocity of Fe from the steel substrate into the aluminum coating has become larger than the diffusion velocity of Al from the aluminum coating into the steel substrate. Secondly, C in the steel substrate combines with O (oxygen) which has reached the steel substrate through defects or clearances in the aluminum coating, thereby to form $CO+CO_2$. The so formed $CO+CO_2$ accumulates in the above-mentioned cavities or voids, which have been formed at the interface between the steel substrate and aluminum coating, and increases the internal pressure within the cavities or voids to drastically decrease the adhesion strength between the steel substrate and aluminum coating. Such adverse effects of C may be completely eliminated by adding to the steel substrate an amount of Ti sufficient to precipitate substantially all the C in the steel as Ti carbide. However, there are great differences as noted below between the case wherein a molten steel from a converter containing at least 0.03% or at least 0.02% of C is directly treated with Ti and the case wherein a molten steel from a converter is further degased under vacuum to a lower carbon level and then treated with Ti.

When the C content is in excess of 0.02% it is not easy to obtain a steel strip having stable mechanical properties and clean surfaces. For example, when a molten steel containing 0.03 to 0.25% of C is treated with an amount of Ti sufficient to fix the carbon and nitrogen in the steel, as is the case with the above-mentioned patent, a great deal of Ti carbide and nitride are precipitated. The nature of the precipitates varies depending upon slight variations of the conditions of the hot rolling and annealing steps, resulting in variations of the strength and ductility of the product. Accordingly, it is not easy to obtain a product having stable mechanical properties. Furthermore, when a molten steel having a relatively high C content is treated with Ti, scums are formed, which appear on the surface of the slab and remain in the subsequent rolled material, becoming a cause of surface flaws. In addition an increased C requires an increased Ti, which is economically disadvantageous. Thus, an increased C is accompanied with various disadvantages, although the strength of the steel may be improved by forming Ti carbide and nitride.

Accordingly, the invention does not expect to strengthen the steel by means of the precipitated Ti carbide and nitride, rather intends to reduce the C content and correspondingly the amount of Ti required. While enjoying an effect of Ti to increase the secondary recrystallization temperature, the invention is to enhance the strength at elevated temperatures up to the increased secondary recrystallization temperature by addition of suitable amounts of Si and Mn. For the reasons set forth above, the C content should be controlled to the lowest possible level, and thus the upper limit of C is now set as 0.020%, preferably 0.017%, and most preferably 0.015%. Such a low level of C may be realized by converter refining followed by vacuum degasing. The lower limit of C is not critical, and may be the lowest possible level which may be economically achieved using a combination of a conventional converter and a vacuum degasing equipment.

Si is an element which contributes to an improvement of the strength at elevated temperatures, which is a main object of the invention. It also contributes to an improvement of the oxidation resistance at elevated temperatures. Si serves to improve the strength at high temperatures by its dissolution in iron. The more the amount of Si the more effective to improve the strength. However, as the Si content exceeds 2.2%, although the strength at elevated temperatures is further improved, the cold workability and weldability grow worse on the one hand, the adhesion of aluminum coating to steel remarkably deteriorates, and thus it becomes difficult to obtain sound aluminum coatings on the other hand. Accordingly, the upper limit of Si is now set as 2.2%. For effective improvement of the strength at elevated temperatures, at least 0.1%, preferably at least 0.2%, the most preferably at least 0.5% of Si is required.

Mn is another element which contributes to an improvement of the strength at elevated temperatures, which is a main object of the invention. Mn serves to improve the strength at elevated temperatures by its dissolution in iron. The more the amount of Mn the more effective to improve the strength. However, as the Mn content exceeds 2.5%, although the strength at elevated temperatures is further improved, the cold workability and weldability tend to remarkably deteriorate on the one hand, there is a danger on the other hand that when the coated product is in service at elevated temperatures up to 800° C., an $\alpha \rightleftarrows \gamma$ transformation may occur in the steel substrate, inviting drastic changes of the mechanical properties. Accordingly, the upper limit of Mn is set as 2.5%.

The Si content and Mn content are mutually dependent. It has been found that in order to achieve a satisfactory level of the strength at elevated temperatures, the relation:

$$1.9\times(\%\ \mathrm{Si})+0.9\times(\%\ \mathrm{Mn})\geqq 1$$

must be satisfied. For a further improvement of the strength at elevated temperatures, % Si and % Mn are preferably controlled in compliance with the relation:

$$1.2\times(\%\ \mathrm{Si})+0.6\times(\%\ \mathrm{Mn})\geqq 1.$$

As is known in the art it is essential to provide a hot rolled material having a quality as uniform as possible so that the subsequent steps of cold rolling and annealing may be carried out without difficulties. For this purpose the hot rolling must be carried out within a stable $\gamma$ range. However, an increase of the Si content results in a rise of the $\alpha \rightleftarrows \gamma$ transformation temperature, making it difficult to finish the hot rolling within the stable $\gamma$ range. On the other hand Mn serves to lower the $\alpha \rightleftarrows \gamma$ transformation temperature. In order that the hot rolling may be finished within the stable $\gamma$ range, it has been found that % Si and % Mn should be further controlled in compliance with the relation:

$$(\%\ \mathrm{Mn})\geqq 0.5\times(\%\ \mathrm{Si}).$$

Figure 6:
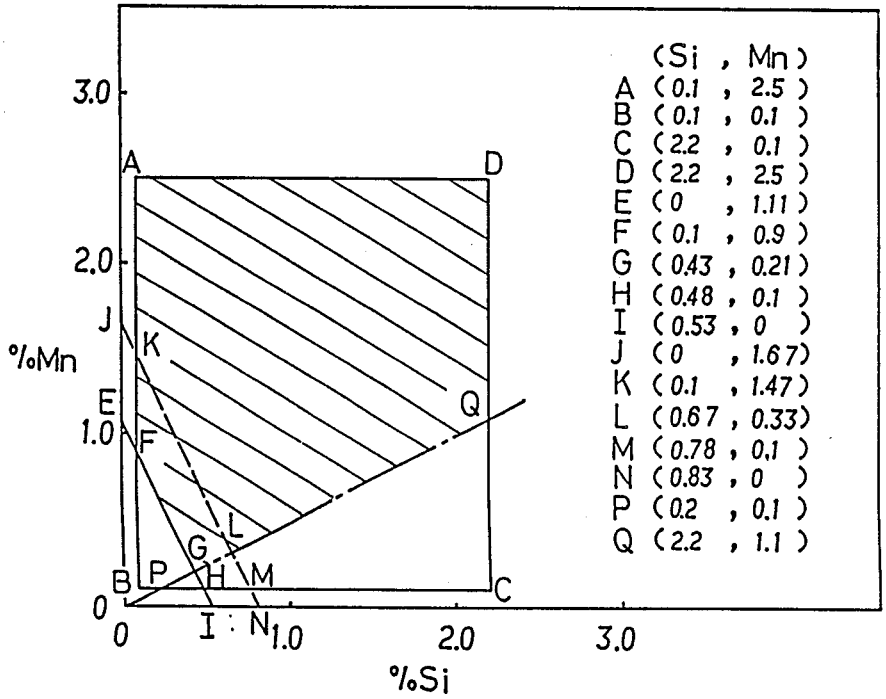
FIG. 6 is a graph showing an interrelation between the Si and Mn content in the steel substrate according to the invention.

FIG. 6 shows the Si and Mn content prescribed by the invention. According to the invention, Si and Mn are added in amounts represented by points within the hatched area shown in FIG. 6, that is within the pentagon defined by points A(0.1, 2.5), F(0.1, 0.9), G(0.43, 0.21), Q(2.2, 1.1) and D(2.2, 2.5). In FIG. 6, line FG represents $$1.9\times(\%\ \mathrm{Si})+0.9\times(\%\ \mathrm{Mn})=1.$$

while line GQ represents $$(\%\ \mathrm{Mn})=0.5\times(\%\ \mathrm{Si}).$$

Preferred Si content and Mn content are represented by points within the pentagon defined by points A(0.1, 2.5), K(0.1, 1.47), L(0.67, 0.33), Q(2.2, 1.1) and D(2.2, 2.5). In FIG. 6, line KL represents $$1.2\times(\%\ \mathrm{Si})+0.6\times(\%\ \mathrm{Mn})=1.$$

Ti is one of the elements which cause Al in the coating layers to effectively diffuse into the steel substrate. Thus, Ti fixes the C and N in the steel as Ti(C,N) precipitates so that the diffusion of Al from the coating layers into the steel substrate may be facilitated, and thus, formation of clearances and voids at the interface between the coating layer and steel substrate may be drastically reduced. By this effect when the aluminum coated product according to the invention is heated at elevated temperatures, there is formed an $\alpha$-Fe layer, which contains a high concentration of Al and is covered at its outermost surface (the outermost surface of the coated product) with a layer of thermally and chemically stable and dense oxides primarily composed of $Al_2O_3$, whereby an excellent oxidation resistance is realized. When Ti is added in an amount of at least 10 times (C+N) in the steel, a sufficient amount of Ti may be present in solution in the steel, thereby the oxidation resistance of the coated product may be further improved. It is believed that this is because when the coated product is heated at elevated temperatures, Ti is selectively oxidized and concentrated at the interface between the above-mentioned $\alpha$-Fe layer containing a high concentration of Al (Al-diffusion layer) and the outermost oxide layer mainly composed of $Al_2O_3$, whereby the latter layer may be made more stable and more dense. In addition Ti acts to raise the secondary recrystallization temperature, thereby to stabilize ferrite grains in the steel up to elevated temperatures. Accordingly, the desired effects of Si and Mn to strengthen the steel by their dissolution in iron may be maintained up to elevated temperatures. The upper limit of Ti is set as 0.5%, since by addition of Ti in excess of 0.5% the comprehensive effects of Ti mentioned above are not proportionally increased, rather the surface qualities of the steel tend to deteriorate. On the other hand an amount of Ti added of less than 0.1% will be insufficient to make the above-mentioned oxide layer mainly composed of $Al_2O_3$ more stable and dense, even if it is sufficient to precipitate the C and N in the steel. Accordingly, at least 0.1% of Ti is required.

Al is added to remove oxygen from the molten steel. In the practice of the invention it is an important element which preliminarily removes oxygen in order to raise the yield of Ti subsequently added. From this point of view at least 0.01% of Al is required. On the other hand addition of Al in excess of 0.1% does not proportionally improve the effect of removing oxygen, rather invites a risk of impairing the surface qualities of the steel. Accordingly, the upper limit of Al is now set as 0.1%.

N in a Ti added steel, as is the case with the invention, is substantially completely precipitated as TiN during melting and solidification of the steel, and the precipitates so formed are scarcely disintegrated or aggregated in any of the subsequent steps. Accordingly, it is preferred to control N to the lowest possible level for effective utilization of Ti. However, it is presently difficult to completely remove N, and thus the N content is now set as not higher than 0.010%.

P and S adversely affects the cold or hot workability of the steel. While it is preferred to control these elements to the lowest possible levels, the presence of up to 0.04% of P and up to 0.04% of S, the levels normally unavoidably included, may be permitted.

The invention will be further described by the following specific examples.

EXAMPLE 1

This Example demonstrates the importance of the coiling temperature prescribed herein in the commercial scale production of hot-dip aluminum coated steel strips. A is an illustration which ended in failure, while B is an instance from success.

A. (Control)

A molten low carbon steel was prepared in an 80 ton LD converter. It was then subjected to refining by a VAD process in a ladle, where it was decarburized by heating under vacuum. By adding thereto subsidiary materials, including ferromanganese, ferrosilicon, aluminum and ferrotitanium, there was prepared a steel consisting essentially of in % by weight 0.013% of C, 1.00% of Si, 1.13% of Mn, 0.022% of P, 0.006% of S, 0.26% of Ti, 0.053% of sol.Al and 0.0030% of N, the balance being Fe and impurities, the ratio % Ti/(% C+% N) being 16.3.

From the steel so prepared, 7 slabs having a cross-section of 190 mm by 940 mm and a length of 7900 mm were prepared by means of a vertical continuous casting apparatus. The slabs were allowed to cool in stack. Each slab was deflawed by means of a scarfer, soaked for 4 hours in a heating furnace maintained at 1280° C., and then immediately hot rolled. During the hot rolling the material was maintained at a finishing temperature of from 900° to 920° C. and at a coiling temperature of from 680° to 720° C. The thickness of the hot rolled material was 3.2 mm.

Each coil of the hot rolled material was allowed to cool and then descaled by means a continuous pickling apparatus using a hydrochloric acid bath.

The descaled material was cold rolled to a thickness of 1.55 mm using a tandem four stand cold roll mill.

After subjected to a surface cleaning treatment, each cold rolled material was passed through a Senzimir type hot-dip aluminum coating line equipped with an in-line annealing equipment, whereby it was coated with Al-Si (9% Si). More particularly, during the in-line annealing the material was maintained at a temperature of at most 700° C. in NOF (non-oxidizing furnace), and at a temperature of from 810° to 830° C. in HZ (heat-zone) subsequent to the NOF. An atmosphere in the HZ was AX gas (decomposed ammonia gas). The residence time of the material in the HZ was about 50 seconds. The material which had left the HZ was cooled in an AX gas atmosphere to a temperature approximate to that of the Al-Si bath, and then passed through the bath. The so coated steel strip was wiped by a pair of jet wipers so that the coating weight might be about 80 g/m$^2$ in total of both sides, properly cooled and then coiled. The coil of the coated material was condition rolled by dull rolls at an elongation ratio of 1.0%.

Results of observation were as follows.

Each coil of the hot rolled material had a layer of internal oxides formed in both surface zones over the whole length of the coil. The layer of internal oxides remained unremoved after scales were removed by pickling. Discrete non-coated areas were observed in the hot-dip coated products. FIG. 3(*a*) is a microscopic photo (with a magnification of 400) showing a cross-section of that portion of the hot-dip coated product where non-coated areas were not found. From this photo it is revealed that the layer of internal oxides remains after hot-dip coating. FIG. 3(*b*) is a microscopic photo (with a magnification of 400) showing a cross-section of the same product shown in FIG. 3(*a*) after it has been heated in air at 800° C. for 20 hours. It will be seen from this photo that no aluminum diffusion layer has been formed on the surface zone of the steel substrate; that Fe scales have been formed immediately under the coating layer; and that the layer of internal oxides has been formed more deeply in the steel substrate. Accordingly, the aluminum coated steel sheets so obtained cannot be said commercial products meeting the desired oxidation resistance at elevated temperatures.

B. (According to the Invention)

The precedures described in A above were repeated except that after the vacuum degasing the steel obtained consisted essentially of in % by weight 0.009% of C, 0.57% of Si, 0.99% of Mn, 0.014% of P, 0.006% of S, 0.30% of Ti, 0.046% of sol.Al, and 0.033% of N, the balance being Fe and impurities, the ratio % Ti/(% C+% N) being 23; that each hot rolled material had a thickness of 4.5 mm and coiled at a temperature of from 530° to 560° C., to prepare similar quantities of the hot-dip aluminum coated steel products.

Results of observation were as follows.

Occurance of internal oxidation was not found in any one of the coils of the hot rolled material. All coated products were free from non-coated areas. FIG. 3(*c*) is a microscopic photo (with a magnification of 400) showing a cross-section of one product. From this photo it reveals that the product is completely free from internal oxidation. FIG. 3(*d*) is a microscopic photo (with a magnification of 400) showing a cross-section of the product shown in FIG. 3(*c*) after it has been heated in air at 800° C. for 20 hours. It will be seen from this photo that an aluminum diffusion layer, which contributes to the oxidation resistance of the product at elevated temperatures, has been formed; that no Fe scales have been formed at the interface between the coating layer and the steel substrate; and that no internal oxidation has proceeded.

EXAMPLE 2

This Example relates to laboratory experiments and demonstrates the importance of the herein prescribed composition of the steel substrate for the strength and oxidation resistance of the product at elevated temperatures.

Using 10 kg vacuum melting vessel steels of compositions as indicated in Table 2 were prepared. Each steel was cast, forged, hot rolled and cold rolled to a thickness of 1.0 mm. The cold rolled material was annealed and had oxide scales on its surfaces removed, and after having been defatted, dipped in a molten Al bath (Al-9% Si) using conventional conditions for hot-dip aluminum coating to provide a coating weight of 80 g/m$^2$. Each sample so prepared was tested for the tensile properties at room temperature and the strength (tensile strength) at 600° C. The sample was further estimated for its oxidation resistances at elevated temperatures by the oxidation weight gain when it was subjected to 10 heating cycles, each cycle comprising heating the coated sample in air to 800° C., maintaining it at the same temperature for 20 hours and cooling it to room temperature. Test results are shown in Table 2.

TABLE 2

| Sample | Chemical Composition (wt %) C | Si | Mn | Ti | Nb | Al | N | Ti/C + N Ratio | Tensile Properties (at room temp.) TS (Kgf/mm$^2$) | YP (Kgf/mm$^2$) | El (%) | Tensile Strength (at 600° C.) (Kgf/mm$^2$) | Oxidation Weight Gain (g/m$^2$) |
|---|---|---|---|---|---|---|---|---|---|---|---|---|---|
| Control | | | | | | | | | | | | | |
| A | 0.013 | 0.01 | 0.21 | — | — | 0.045 | 0.012 | — | 35 | 23 | 48 | 10 | 763 |
| B | 0.009 | 0.01 | 0.27 | 0.08 | — | 0.048 | 0.008 | 4.7 | 32 | 11 | 50 | 10 | 30 |
| C | 0.008 | 0.02 | 0.30 | 0.18 | — | 0.051 | 0.006 | 12.9 | 31 | 10 | 51 | 9 | 16 |
| D | 0.011 | 2.83 | 0.61 | 0.26 | — | 0.045 | 0.009 | 13.0 | 56 | 42 | 24 | 31 | 38 |
| E | 0.009 | 0.37 | 3.30 | 0.24 | — | 0.026 | 0.008 | 14.1 | 44 | 26 | 35 | 25 | 20 |
| F | 0.008 | 1.50 | 0.86 | — | — | 0.031 | 0.005 | — | 45 | 29 | 37 | 24 | 505 |
| According to the Invention | | | | | | | | | | | | | |
| G | 0.009 | 0.55 | 0.60 | 0.21 | — | 0.051 | 0.004 | 16.2 | 36 | 18 | 43 | 17 | 17 |
| H | 0.009 | 1.15 | 1.21 | 0.25 | — | 0.060 | 0.004 | 19.2 | 44 | 26 | 38 | 23 | 16 |
| I | 0.010 | 1.05 | 2.05 | 0.19 | — | 0.035 | 0.005 | 12.7 | 46 | 29 | 37 | 27 | 17 |
| J | 0.006 | 2.02 | 1.13 | 0.23 | — | 0.053 | 0.006 | 19.2 | 51 | 35 | 33 | 29 | 13 |
| K | 0.006 | 2.12 | 1.96 | 0.18 | — | 0.041 | 0.007 | 13.9 | 55 | 40 | 31 | 32 | 15 |

Table 2 reveals the following.

Samples A, B and C are controls having the Si and Mn content outside the scope of the invention with varied Ti content and Ti/(C+N) ratio. These three samples with the Si and Mn content outside the scope of the invention all exhibit unsatisfactory strengths at 600° C., irrespective of the Ti content. When the oxidation weight gains of these three samples are compared that of Sample C having the highest Ti content and Ti/(C+N) ratio is the lowest, indicating the beneficial effect of Ti on the oxidation resistance. However, this sample cannot achieve the object of the invention because of its poor strengh at elevated temperatures.

Samples D and E respectively have the Si and Mn content in excess of the respective upper limits prescribed herein, and thus constitute controls. Sample D has an improved strength at elevated temperatures, but its elongation at room temperature is poor. Non-coated areas were observed in Sample D, and thus it exhibits a high oxidation weight gain. Sample E has a desirably high strength at elevated temperatures and a satisfactorily low oxidation weight gain. But its mechanical properties at room temperature vary to a great extent depending upon the annealing conditions.

Sample F is a control in that it has no Ti added although its Si and Mn content is within the scope of the invention. This sample has an improved strength at elevated temperatures, but is totally unacceptable because of its poor oxidation resistance at elevated temperatures.

Samples G to K are within the scope of the invention. Comparison of these 5 Samples with Sample C reveals that the addition of Si and Mn to such Ti-containing base steels in accordance with the invention contributes to enhancement of the strengths both at room and elevated temperatures without sacrificing the oxidation resistance of the coated products at elevated temperatures.

We claim:

1. A process for the production of a hot-dip aluminum coated steel strip comprising sequentially subjecting a slab of steel having an amount of titanium added sufficient to fix the carbon and nitrogen in said steel as stable precipitates and to provide an excess of uncombined titanium to the steps of hot rolling, descaling, cold rolling, annealing and hot-dip aluminum coating, characterized in that as said slab use is made of a Ti-added Si-Mn steel which comprises in % by weight up to 0.020% of C, 0.1 to 2.2% of Si, up to 2.5% of Mn, 0.1 to 0.5% of Ti, 0.01 to 0.1% of Al and up to 0.010% of N, the balance being Fe and unavoidable impurities, the % Si, % Mn, % Ti, % C and % N being further controlled in compliance with the relations:

$$1.9\times(\%\ Si)+0.9(\%\ Mn)\geqq 1,$$

$$\%\ Mn\geqq 0.5\times(\%\ Si),\ \text{and}$$

$$\%\ Ti/(\%\ C+\%\ N)\geqq 10,\ \text{and}$$

that in said hot rolling step the temperature of the hot rolled material being coiled is controlled low enough to provide steel surfaces substantially free from internal oxidation at the end said descaling step.

2. The process in accordance with claim 1 wherein the temperature of the hot rolled material being coiled is controlled not higher than about 600° C.

3. The process in accordance with claim 1 wherein the temperature of the hot rolled material being coiled is controlled not higher than about 570° C.

4. The process in accordance with any one of the preceding claims wherein the % Si and % Mn are further controlled in compliance with the relation:

$$1.2\times(\%\ Si)+0.6\times(\%\ Mn)\geqq 1.$$

5. A hot-dip aluminum coated steel strip or sheet having excellent strength and oxidation resistance at elevated temperatures, comprising as the steel substrate a Ti-added Si-Mn steel which consists essentially of in % by weight up to 0.020% of C, 0.1 to 2.2% of Si, up to 2.5% of Mn, 0.1 to 0.5% of Ti, 0.01 to 0.1% of Al and up to 0.010% of N, the balance being Fe and unavoidable impurities, the % Si, % Mn, % Ti, % C and % N being further controlled in compliance with the relations:

$$1.9\times(\%\ Si)+0.9\times(\%\ Mn)\geqq 1,$$

$$\%\ Mn\geqq 0.5\times(\%\ Si)$$

and $$\%\ Ti/(\%\ C+\%\ N)\geqq 10,$$

said steel being substantially free from internal oxidation.

6. The hot-dip aluminum coated steel strip or sheet in accordance with claim 4 wherein the % Si and % Mn are further controlled in compliance with the relation:

$$1.2\times(\%\ Si)+0.6\times(\%\ Mn)\geqq 1.$$

* * * * *